US009371500B2

(12) United States Patent
Zehler

(10) Patent No.: US 9,371,500 B2
(45) **Date of Patent: *Jun. 21, 2016**

(54) LUBRICANT COMPOSITIONS WITH IMPROVED OXIDATION STABILITY AND SERVICE LIFE

(71) Applicant: COGNIS IP MANAGEMENT GMBH, Duesseldorf (DE)

(72) Inventor: Eugene R. Zehler, West Chester, OH (US)

(73) Assignee: COGNIS IP MANAGEMENT GMBH, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/627,751

(22) Filed: Feb. 20, 2015

(65) Prior Publication Data

US 2015/0159111 A1 Jun. 11, 2015

Related U.S. Application Data

(63) Continuation of application No. 13/197,037, filed on Aug. 3, 2011, now Pat. No. 8,980,808.

(51) Int. Cl.

| | |
|---|---|
| ***C10M 169/04*** | (2006.01) |
| ***C10M 141/06*** | (2006.01) |
| ***C10M 133/12*** | (2006.01) |
| ***C10M 129/74*** | (2006.01) |

(52) U.S. Cl.

CPC ..... *C10M 169/04* (2013.01); *C10M 129/74* (2013.01); *C10M 2203/045* (2013.01); *C10M 2203/1006* (2013.01); *C10M 2205/003* (2013.01); *C10M 2205/022* (2013.01); *C10M 2205/028* (2013.01); *C10M 2205/0265* (2013.01); *C10M 2205/0285* (2013.01); *C10M 2205/173* (2013.01); *C10M 2207/282* (2013.01); *C10M 2207/289* (2013.01); *C10M 2207/2835* (2013.01); *C10M 2209/105* (2013.01); *C10M 2209/1033* (2013.01); *C10M 2209/1085* (2013.01); *C10M 2215/064* (2013.01); *C10M 2215/065* (2013.01); *C10M 2219/066* (2013.01); *C10M 2219/084* (2013.01); *C10M 2229/025* (2013.01); *C10N 2220/028* (2013.01); *C10N 2230/10* (2013.01); *C10N 2240/02* (2013.01); *C10N 2240/04* (2013.01); *C10N 2240/08* (2013.01); *C10N 2240/30* (2013.01); *C10N 2240/52* (2013.01)

(58) Field of Classification Search

CPC ..... C10M 169/04; C10M 129/74; C10M 2203/045; C10M 2203/1006; C10M 2205/003; C10M 2205/022; C10M 2205/0265; C10M 2205/028; C10M 2205/0285; C10M 2205/173; C10M 2207/282; C10M 2207/2835; C10M 2207/289; C10M 2209/105; C10M 2209/1085; C10M 2215/064; C10M 2215/065; C10M 2219/066; C10M 2219/084; C10M 2229/025; C10N 2220/028; C10N 2230/10; C10N 2240/02; C10N 2240/04; C10N 2240/08; C10N 2240/30; C10N 2240/52

USPC ..... 508/202, 485, 563

See application file for complete search history.

(56) References Cited

U.S. PATENT DOCUMENTS

| | | | |
|---|---|---|---|
| 2,961,406 | A | 11/1960 | McNeil, Jr. et al. |
| 4,175,045 | A | 11/1979 | Timothy |
| 5,665,686 | A | 9/1997 | Schlosberg et al. |
| 5,698,502 | A | 12/1997 | Pafford et al. |
| 5,728,658 | A | 3/1998 | Duncan |
| 5,783,528 | A | 7/1998 | Rodenberg |
| 6,221,272 | B1 | 4/2001 | Schnur et al. |
| 6,235,691 | B1 | 5/2001 | Boffa et al. |
| 6,436,881 | B1 | 8/2002 | McHenry et al. |
| 6,713,438 | B1 | 3/2004 | Baillargeon et al. |
| 6,713,439 | B2 | 3/2004 | Watts |
| 6,759,373 | B2 | 7/2004 | Tazaki |
| 6,774,093 | B2 | 8/2004 | Carr et al. |

(Continued)

FOREIGN PATENT DOCUMENTS

| | | | |
|---|---|---|---|
| CN | 1668726 | A | 9/2005 |
| JP | H 06-087730 | A | 3/1994 |

(Continued)

OTHER PUBLICATIONS

English Language abstract for JP 06087730 extracted from PAJ database on Oct. 9, 2014, 9 pages.

(Continued)

*Primary Examiner* — James Goloboy

(74) *Attorney, Agent, or Firm* — Howard & Howard Attorneys PLLC

(57) ABSTRACT

Provided are lubricants containing a synthetic ester, one or more additional base stocks and an additive package along with methods of making and using the same. Lubricant compositions comprise a synthetic ester that is a reaction product of at least one hindered organic polyol with one or more carboxylic acid where at least some (20%) up to 100% of the acids are branched. The lubricant compositions can provide improved oxidation stability and extended service life, as compared to a lubricant whose ester component is the reaction product of one or more hindered organic polyols and one or more carboxylic acids that are all linear, in applications that involve exposure to air, moisture, and/or high temperatures. These lubricant compositions are suited to a variety of lubricant applications, including, but not limited to air compressors, gear boxes, bearing sets, hydraulic systems, and chain drives.

20 Claims, No Drawings

(56) References Cited

U.S. PATENT DOCUMENTS

| | | | | |
|---|---|---|---|---|
| 6,844,301 | B2 | 1/2005 | Field et al. | |
| 7,465,696 | B2 | 12/2008 | Roby et al. | |
| 8,980,808 | B2 * | 3/2015 | Zehler | 508/506 |
| 2001/0035518 | A1 | 11/2001 | Schnur et al. | |
| 2002/0193262 | A1 | 12/2002 | Kaimai et al. | |
| 2003/0104956 | A1 | 6/2003 | Schaefer et al. | |
| 2004/0038833 | A1 | 2/2004 | Deckman et al. | |
| 2004/0119046 | A1 | 6/2004 | Carey et al. | |
| 2004/0154957 | A1 | 8/2004 | Keeney et al. | |
| 2004/0154958 | A1 | 8/2004 | Alexander et al. | |
| 2005/0096236 | A1 * | 5/2005 | Le Sausse et al. | 508/439 |
| 2006/0281643 | A1 | 12/2006 | Habeeb et al. | |
| 2007/0000807 | A1 | 1/2007 | Wu et al. | |
| 2007/0142247 | A1 | 6/2007 | Baillargeon et al. | |
| 2007/0179069 | A1 | 8/2007 | Burgo et al. | |
| 2008/0242568 | A1 | 10/2008 | Poirier | |
| 2009/0298731 | A1 | 12/2009 | Housel et al. | |
| 2010/0105591 | A1 * | 4/2010 | Rosenbaum et al. | 508/584 |
| 2010/0117022 | A1 | 5/2010 | Carr et al. | |
| 2010/0218740 | A1 * | 9/2010 | Teshima et al. | 123/196 R |
| 2010/0261628 | A1 | 10/2010 | Scherer et al. | |

FOREIGN PATENT DOCUMENTS

| | | | |
|---|---|---|---|
| JP | H 09-208980 | A | 8/1997 |
| JP | H 10-505623 | A | 6/1998 |
| JP | 2001-501991 | A | 2/2001 |
| JP | 2001-139972 | A | 5/2001 |
| JP | 2004-010894 | A | 1/2004 |
| WO | WO 96/07721 | A1 | 3/1996 |
| WO | WO 99/16849 | A1 | 4/1999 |
| WO | WO 00/24849 | A1 | 5/2000 |
| WO | WO 01/48127 | A1 | 7/2001 |

OTHER PUBLICATIONS

International Search Report for Application No. PCT/EP2012/061677 dated Aug. 29, 2012, 4 pages.

English Language abstract not found for CN 1668726; however, see English language equivalent U.S. Pat. No. 6,774,093. Original document extracted from espacenet.com database on Jan. 15, 2015, 12 pages.

English language translation of Wang Jiu et al., "Basic Knowledge of Additives for Petroleum Products", China Petrochemical Press, 10, 2009, pp. 63-64 provided by CCPIT Patent & Trademark Law Office on Oct. 23, 2015.

English language abstract and machine-assisted English translation for JPH 09-208980 extracted from espacenet.com database on Feb. 17, 2016, 20 pages.

English language abstract for JPH 10-505623 extracted from espacenet.com database on Feb. 17, 2016, 2 pages.

English language abstract for JP 2001-501991 extracted from espacenet.com database on Feb. 17, 2016, 2 pages.

English language abstract for JP 2001-139972 extracted from espacenet.com database on Feb. 17, 2016, 2 pages.

English language abstract for JP 2004-010894 extracted from espacenet.com database on Feb. 17, 2016, 2 pages.

English language abstract for WO 01/48127 extracted from espacenet.com database on Feb. 17, 2016, 2 pages.

* cited by examiner

LUBRICANT COMPOSITIONS WITH IMPROVED OXIDATION STABILITY AND SERVICE LIFE

RELATED APPLICATIONS

This application is a continuation of U.S. patent application Ser. No. 13/197,037, filed on Aug. 3, 2011.

FIELD

The present invention relates to the field of lubricant compositions comprising selected esters with other base stocks, and to the use of these lubricant compositions in a variety of applications. Specifically provided are synthetic esters that are reaction products of hindered polyols with branched carboxylic acids of carbon chain length of at least five carbons or higher, where the synthetic esters are mixed with one or more additional base stocks to provide enhanced oxidation life/stability.

BACKGROUND

Lubricants for use with air compressors, engine oils, gear oils, hydraulic fluids, and the like, require excellent characteristics of high viscosity index, good lubricity, high oxidation stability, and high thermal stability. Oxidation stability is important due to repeated and prolonged exposure of the lubricant to air, various metallurgies, and sealing materials. A desirable lubricant composition remains in a liquid phase over a wide temperature range, has good low temperature fluidity, has a low vapor pressure, and is operable over an extended period of time at wide ranging temperatures and pressures. Viscosity at high temperatures should be sufficient to provide adequate lubrication, and at low temperatures should be low enough to allow start-up of the compressor at subzero temperatures without the need for external heating.

In addition to its effect on the useful service life of the lubricant itself, the oxidation stability of the lubricant also affects the performance of the compressor equipment. One of the most difficult lubricant-related problems encountered in compressor equipment is the formation of carbon deposits within the compressor and associated piping. This is caused by oxidation of lubricant contained in the air stream as it passes through the equipment.

Compressor lubricants, as well as lubricants used in other applications, are often brought into direct and intimate contact with gas. This contact generally occurs at elevated temperatures and pressures, and is repetitive. Where the gas coming in contact with the lubricant is air, the oxygen content of the air in combination with the high pressure and high temperature presents an oxidizing atmosphere that is very severe. Hence, lubricants with enhanced oxidation stability are greatly needed.

Enhanced oxidation stability is also highly desired in other applications, such as in the lubrication of gear boxes, bearing sets, hydraulic systems and chain drives. When oxidation is problematic in these types of applications, sludge and carbon/varnish deposits appear on the metal surfaces, which may adversely impact the functioning of the equipment, and result in increased downtime and higher maintenance costs. Additionally, lubricants and fluids used in gear boxes, bearing sets, hydraulic systems and chain drive applications are expected to survive for long drain intervals; therefore, increased service life of the lubricant is desired.

Lubricant composition adapted for high temperature applications have been described previously. For example, U.S. Pat. No. 4,175,045 to Timony describes a synthetic lubricant composition comprising a polyol ester of a carboxylic acid having from about 4 to about 13 carbon atoms in its structure. Further, U.S. Pat. No. 6,436,881 to McHenry et al. describes a synthetic polyol ester based lubricant that has a base stock that is the reaction of a polyol mixture including a major proportion of dipentaerythritol, and a mixture of monocarboxylic acids. Conventional lubricants that are composed of some level of synthetic or natural esters can show evidence of limited oxidation stability while in service in air compressor and other applications, thus leading to limited service life. Accordingly, there is a need for lubricant compositions that provide improved oxidation stability when exposed to moisture and high temperatures. The present invention addresses these needs, among others.

SUMMARY

Provided are improved lubricants containing a synthetic ester and at least one additional base stock along with methods of making and using the same. Applicants have developed improved lubricant compositions comprising a synthetic ester that is a reaction product of at least one hindered organic polyol with one or more carboxylic acid where at least some (20%) and up to 100% of the acids are branched. Such resulting esters can be referred to as hindered organic polyol esters or even hindered polyol esters. The lubricant compositions can provide improved oxidation stability and extended service life, as compared to a lubricant whose ester component is the reaction product of one or more hindered organic polyols and one or more carboxylic acids that are all linear (i.e., 100% non-branched), in applications, for example, that involve exposure to air, moisture, and/or high temperatures. The synthetic ester base stock is mixed with at least a second base stock, and optionally a third, a fourth, or more base stocks, and an additive package. These lubricant compositions are suited to a variety of lubricant applications, including, but not limited to air compressors, gear boxes, bearing sets, hydraulic systems, and chain drives.

In certain embodiments, the lubricant compositions comprise: a synthetic ester base stock that is a reaction product of a mixture comprising one or more hindered organic polyols and one or more carboxylic acids with a chain length of at least five carbons, wherein at least 20% of the carboxylic acids are a branched carboxylic acid; one or more additional base stocks; and a performance additive package comprising at least one additive effective to improve at least one property of the lubricant and/or the performance of the equipment in which the lubricant is to be used. In certain embodiments, the additive package includes an antioxidant.

In one embodiment, 100% of the carboxylic acids are branched. Other embodiments provide that the carboxylic acids have a carbon chain length of 5 or more, 6 or more, 7 or more, or even 8 or 9 or more. In a detailed embodiment, the branched carboxylic acids have chain lengths that consist of eight or nine carbon atoms. For example, such branched carboxylic acids can be selected from the group consisting of 2-ethylhexanoic acid, isononanoic acid, and combinations thereof. In other embodiments, the branched carboxylic acids have chain lengths that consist only of eight carbon atoms.

A detailed embodiment provides that the synthetic ester base stock is present in the lubricant in an amount in the range of about 2 to about 80 percent (or about 5 to about 70%, or about 10 to about 50%, or even about 10 to about 35%) by weight of the total lubricant composition. The performance additive package can be present in an amount in the range of about 0.1 to about 10 percent by weight of the total lubricant composition. The one or more additional base stocks are present in an amount that is the remainder of the total lubricant composition. That is, the additional base stock(s) can be present in an amount in the range of about 10 to about 98 percent (or about 20 to about 95%, or about 40 to about 90%, or even about 55 to about 90%) by weight of the total lubricant composition.

In certain embodiments, the one or more additional base stocks of the lubricant composition are independently selected from the group consisting of polyalkylene glycols, polyglycol ethers, polyethers, polyolefins, olefin copolymers, polyalphaolefins, polybutene, mineral oils, highly refined mineral oils, highly paraffinic Fischer-Tropsch-derived base fluids, silicones, alkylated naphthalenes and mixtures thereof. In another embodiment of the present invention, the performance additive package of the lubricant composition comprises an oxidation inhibitor. Other embodiments provide that the one or more additional base stocks are selected from the group consisting of polyalkylene glycols, polyolefins, olefin copolymers, polyalphaolefins, highly paraffinic Fischer-Tropsch-derived base fluids, and mixtures thereof.

Other embodiments provide that the one or more hindered organic polyols comprises a pentaerythritol, a trimethylolpropane-based component, or both. For example, the one or more hindered organic polyols can comprise one or more pentaerythritols selected from the group consisting of: monopentaerythritol, dipentaerythritol, tripentaerythritol, and tetrapentaerythritol. In another example, the one or more hindered organic polyols can comprise one or more trimethylolpropane-based components selected from the group consisting of trimethylolpropane and di-trimethylolpropane.

In one or more embodiments, the synthetic ester is the reaction product of one or more pentaerythritols selected from the group consisting of: monopentaerythritol, dipentaerythritol, tripentaerythritol, and tetrapentaerythritol with one or more branched carboxylic acids selected from the group consisting of 2-ethylhexanoic acid and isononanoic acid.

A detailed aspect includes a lubricant composition for open compressors, the lubricant comprising: a synthetic ester base stock that is a reaction product of a mixture comprising: one or more hindered organic polyols, and one or more carboxylic acids with a carbon chain length of eight or nine or both, wherein 100% of the one or more carboxylic acids are branched; one or more additional base stocks; and a performance additive package.

Also provided are methods of lubricating pieces of equipment, the methods comprising: providing the lubricant compositions provided herein and filling a chamber or exposing a surface of the piece of equipment with the lubricant. In a detailed embodiment, the equipment is selected from the group consisting of: air compressors, gear boxes, bearing sets, hydraulic systems, and chain drives.

DETAILED DESCRIPTION

The present invention relates to lubricant compositions that provide improved oxidation stability when exposed to air, moisture, and/or high temperatures. Such lubricants are especially suited to lubricant applications where moisture is drawn in with incoming air and subsequently intermingled with the lubricant during the normal lubrication process. In particular such compressors are considered "open", as contrasted with the hermetically sealed systems that are used to compress refrigeration fluids.

In one aspect, the lubricant compositions comprise a hindered organic polyol ester base stock that is synthesized from one or more hindered organic polyols, and branched carboxylic acids with a chain length of at least five carbons long, wherein at least 20% of the carboxylic acids are branched; one or more additional base stocks; and a performance additive package comprising at least one additive effective to improve at least one property of the lubricant and/or the performance of the equipment in which the lubricant is to be used.

Hindered Organic Polyols

Reference to a hindered organic polyol means an organic molecule containing at least five carbon atoms, at least two hydroxyl (—OH) groups, and no hydrogen atoms on any carbon atom directly attached to a carbon atom bearing an —OH group. That is, there are no hydrogen atoms on the B-carbon. In one or more embodiments, the hindered organic polyol comprises an aliphatic organic molecule with one or more quaternary carbon atoms having at least two and preferably two, three, or four methylol groups. One example of such a hindered organic polyol is (mono)pentaerythritol (2,2-dimethylol-1,3-propanediol).

In other embodiments, the polyols used to synthesize the ester base stock is comprised of a mixture of polyols. One or more specific embodiments provide that the hindered organic polyol is a mixture of one or more of the following pentaerythritols: monopentaerythritol, dipentaerythritol, tripentaerythritol, and tetrapentaerythritol. Other suitable hindered organic polyols include, but are not limited to various trimethylolpropane-based components such as trimethylolpropane ("TMP"; 2,2-dimethylol-1-butanol) and di-trimethylolpropane ("DTMP").

It is understood that as needed, other alcohols that are not hindered can be added as needed to provide esters of desired properties Such alcohols could include glycols such as polyethylene glycol or polypropylene glycol.

Carboxylic Acids

Reference to a carboxylic acid means an organic molecule containing a carboxyl group (—COOH or —$CO_2H$) groups. Branched carboxylic acids have side chains off of a hydrocarbon backbone. Carboxylic acids used with the synthetic esters can have chains of 5, 6, 7, 8 or 9 or more carbons. In one or more embodiments, the carboxylic acids are monobasic, that is they only provide one location on the chain for esterification with an alcohol. In certain embodiments, the carboxylic acid comprises 20% or more branched carboxylic acids (or 30% or more, or 40% or more, or 50% or more, or 60% or more, or 70% or more, or 80% or more, or 90% or more, or even 100%). Exemplary branched carboxylic acids include but are not limited to isopentanoic acid, 2-ethylhexanoic acid, isononanoic acid.

Other possible carboxylic acids, branched or unbranched include, but are not limited to, 2,2-dimethylpropanoic acid, neoheptanoic acid, neo-octanoic acid, neononanoic acid, isohexanoic acid, neodecanoic acid, 2-ethylhexanoic acid, 3,5,5-trimethyl hexanoic acid, isoheptanoic acid, iso-octanoic acid, isononanoic acid, isostearic acid, isopalmitic acid and isodecanoic acid, butyric acid, valeric acid, caproic acid, heptanoic acid, caprylic acid, pelargonic acid, capric acid, undecanoic acid, lauric acid, tridecanoic acid, tetradecanoic acid, pentadecanoic acid, palmitic acid, margaric acid, stearic acid, nonadecanoic acid, arachic acid, behenic acid, lignoceric acid, myristic acid, cerotic acid, melissic acid, tricosanoic acid, Guerbet acid C 32 (reaction product of the guerbetization of palmitic acid), Guerbet acid C 34 (reaction product of the guerbetization of palmitic acid with stearic acid) or Guerbet acid C 36 (reaction product of the guerbetization of stearic acid) and pentacosanoic acid.

In one or more embodiments, carboxylic acids exclude isopentanoic acid. In alternative embodiments, mixtures of carboxylic acids, including those with different chain lengths and functionalities, are utilized. Although in certain embodiments, the carboxylic acids may be monobasic or dibasic, monobasic acids are preferred. Suitable dibasic acids include, but are not limited to adipic acid, azelaic acid, and sebacic acid. It is also preferred that saturated acids be used. In one or more embodiments, the carboxylic acids exclude unsaturated acids.

Synthetic Ester Base Stock

The synthetic ester base stock provided can also be referred to as a hindered organic polyol ester base stock. In certain embodiments, the hindered organic polyol ester base stock makes up from about 2 to about 80 percent by weight of the total lubricant composition, the performance additive package makes up from about 0.1 to about 10 percent by weight of the total lubricant composition, and the one or more additional base stocks makes up the remainder of the total lubricant composition. In other embodiments, the hindered organic polyol ester base stock makes up from about 5 to about 70 percent by weight of the total lubricant composition. In other embodiments, the hindered organic polyol ester base stock makes up from about 10 to about 50 percent by weight of the total lubricant composition. In further embodiments, the hindered organic polyol ester base stock makes up from about 10 to about 35 percent by weight of the total lubricant composition. In general, however, it is contemplated that these components may be present in compositions in widely varying amounts depending on the particular needs of each application, and all such variations are considered to be within the broad scope of the invention.

The polyol ester base stock reaction product is formed by reacting the hindered organic polyol, or mixture of polyols, with a mixture of branched and unbranched carboxylic acids or with 100% branched carboxylic acids.

Additional Base Stock(s)

In certain embodiments, the synthetic ester base stock is used in conjunction with one or more additional base stocks to create the lubricant composition. These one or more additional base stocks are selected from the group consisting of polyalkylene glycols, polyglycol ethers, polyethers, polyolefins, olefin copolymers, polyalphaolefins, polybutene, mineral oils, highly refined mineral oils, highly paraffinic Fischer-Tropsch-derived base fluids, silicones, alkylated naphthalenes and mixtures thereof. A detailed embodiment provides that the one or more additional base stocks only includes one or more of polyalkylene glycols, polyolefins, olefin copolymers, polyalphaolefins, and highly paraffinic Fischer-Tropsch-derived base fluids. A detailed embodiment provides that the one or more additional base stocks excludes alkylated naphthalenes.

Additives

Under some conditions of use, the esters described above will function satisfactorily as complete lubricants. It is generally preferable, however, for a complete lubricant to contain other materials generally denoted in the art as additives, such as oxidation resistance (antioxidants) and thermal stability improvers, corrosion inhibitors, metal deactivators, lubricity additives, viscosity index improvers, pour and/or floc point depressants, detergents, dispersants, antifoaming agents, anti-wear agents, and extreme pressure resistant additives. Many additives are multifunctional. For example, certain additives may impart both anti-wear and extreme pressure resistance properties, or function both as a metal deactivator and a corrosion inhibitor. Cumulatively, all additives, collectively termed a performance additive package, preferably do not exceed about 10% by weight of the total lubricant composition.

An effective amount of the foregoing additive types is generally in the range of from about 0.01% to about 5% for the antioxidant component, of from about 0.01% to about 5% for the corrosion inhibitor component, of from about 0.001% to about 0.5% for the metal deactivator component, of from about 0.01% to about 5% for the lubricity additives, of from about 0.01% to about 2% for each of the viscosity index improvers and pour and/or floc point depressants, of from about 0.1% to about 5% for each of the detergents and dispersants, of from about 0.001% to about 0.1% for anti-foam agents, and of from about 0.01% to about 2% for each of the anti-wear and extreme pressure resistance components. All of these percentages are by weight and are based on the total lubricant composition. It is to be understood that more or less than the stated amounts of additives may be more suitable to particular circumstances, and that a single molecular type or a mixture of types may be used for each type of additive component.

Non-limiting examples of suitable oxidation resistance (antioxidant) and thermal stability improvers are diphenly-, dinaphtyl-, and phenyl-naphthyl-amines, in which the phenyl and naphthyl groups can be substituted, for example, N,N'-diphenyl phenylenediamine, p-octyldiphenylamine, p,p-dioctyldiphenylamine, alkylated diphenylamine, alkylated phenyl alpha naphthylamine, N-phenyl- 1-naphthyl amine, N-phenyl-2-naphthyl amine, N-(p-dodecyl)-phenyl-2-naphthyl amine, di-1-naphthylamine, and di-2-naphthylamine; phenothazines such as N-alkylphenothiazines; imino (-bis-benzyl); hindered phenols such as 6-(t-butyl)phenol, 2,6-di-(t-butyl)phenol, 4-methyl-2, 6-di-(t-butyl)phenol, 4,4'-methylenebis (-2,6-di-{t-butyl}-phenol), esters of 3,5-di-tert-butyl-4-hydroxyhydrocinnamic acid, thiodiethylene bis-(3,5-di-tert-butyl-4-hydroxy) hydrocinnamate, esters of [[[3,5-bis(1,1-dimethylethyl)-4-hydroxyphenyl]methyl]thio]acetic acid; dithiocarbamates, such as for example methylene-bis-dibutyldithiocarbamate, and the like.

Examples of suitable cuprous metal deactivators are imidazole, benzamidazole, 2-mercaptobenzthiazole, 2,5-diercaptothiadiazole, salicylidine-propylenediamine, pyrazole, benzotriazole, tolutriazole, 2-methylbenza-midazole, 3,5-dimethyl pyrazole, and methylene bis-benzo-triazole. Benzotriazole derivatives are preferred. Other examples of more general metal deactivators and/or corrosion inhibitors include organic acids and their esters, metal salts, and anhydrides, for example, N-oleylsar-cosine, sorbitan monooleate, lead naphthenate, dodecanyl-succinic acid and its partial esters and amides, and 4-nonylphenoxy acetic acid; primary, secondary, and tertiary aliphatic and cycloaliphatic amines and amine salts of organic and inorganic acids, for example, oil-soluble alkylammonium carboxylates; heterocyclic nitrogen containing compounds, for example, thiadiazoles, substituted imidazolines, and oxazolines; quinolines, quinones, and anthraquinones; propyl gallate; neutral and basic sulfonates, such as ammonium, amine, calcium, magnesium, zinc, sodium or barium dinonyl naphthalene sulfonate; over-based sulfonates; complex sulfonates; barium dinonyl naphthalene sulfonate; ester and amide derivatives of alkenyl succinic anhydrides or acids, dithiocarbamates, dithiophosphates; amine salts of alkyl acid phosphates and their derivatives and amino acid derivatives. Examples of suitable lubricity additives include long chain derivatives of fatty acids and natural oils, such as esters, amines, amides, imidazolines, and borates.

Examples of suitable viscosity index improvers include polymethacrylates, copolymers of vinyl pyrrolidone and methacrylates, polybutenes, styreneacrylate copolymers, and copolymers of ethylene and propylene.

Examples of suitable pour point and/or floc point depressants include polymethacrylates such as methacrylate-ethylene-vinyl acetate terpolymers; alkylated naphthalene derivatives; and products of Friedel-Crafts catalyzed condensation of urea with naphthalene or phenols.

Examples of suitable detergents and/or dispersants include polybutenylsuccinic acid amides; polybutenyl phosphonic acid derivatives; long chain alkyl substituted aromatic sulfonic acids and their salts; and metal salts of alkyl sulfides, of alkyl phenols, and of condensation products of alkyl phenols and aldehydes.

Examples of suitable anti-foam agents include silicone polymers and some acrylates. Examples of suitable anti-wear and extreme pressure resistance agents include sulfurized fatty acids and fatty acid esters, such as sulfurized octyl tallate; sulfurized terpenes; sulfurized olefins; organopolysulfides; organo phosphorus derivatives including amine phosphates, alkyl acid phosphates, dialkyl phosphates, dithiophosphates, trialkyl and triaryl phosphorothionates, trialkyl and triaryl phosphines, and dialkylphosphites, for example, amine salts of phosphoric acid monohexyl ester, amine salts of dinonylnaphthalene sulfonate, triphenyl phosphate, trinaphthyl phosphate, diphenyl cresyl and dicresyl phenyl phosphates, naphthyl diphenyl phosphate, triphenylphosphorothionate; dithiocarbamates, such as an antimony dialkyl dithiocarbamate; chlorinated and/or fluorinated hydrocarbons, and xanthates.

Synthesis of Hindered Organic Polyol Ester Base Stock

When preparing the synthetic hindered organic polyol ester, the desired amount of hindered organic polyol and carboxylic acid is placed into a reaction vessel. Typically, the quantity of acid charged to the reaction mixture initially is sufficient to provide an excess of from about 1.1% to about 1.2% of equivalents of acid over the equivalents of alcohol reacted therewith. An equivalent of acid is defined for the purposes of this specification as the amount containing 1 gram equivalent weight of carboxyl groups, whereas an equivalent of alcohol is the amount containing 1 gram equivalent weight of hydroxyl groups. The esterification reaction is carried out at elevated temperature while removing water. The reaction may be carried out by refluxing the reactants in an azeotropic solvent, such as toluene or xylene, to facilitate removal of water. Esterification catalysts may be used, but are not necessary for the reaction. Upon completion of the reaction, excess acid and any solvent may be conveniently separated from the ester product by vacuum stripping or distillation.

The ester product thus produced may be utilized as such, or it may be alkali refined or otherwise treated to reduce the acid number, remove catalyst residue, reduce ash content, or other undesired impurities. If the ester product is subject to alkali refining, the resultant product should be washed with water to remove any unreacted excess alkali and the small amount of soap form from the excess fatty acid neutralized by the alkali before using the ester as a base stock and/or lubricant.

Depending on the end-use of the lubricant, certain embodiments of the lubricant composition have an ISO viscosity grade ranging from about 7 to about 460. Other embodiments have an ISO viscosity grade up to about 1000.

The present invention will be better understood with reference to the following examples. The examples are presented for the purpose of illustration only and are not intended to be construed in a limiting sense.

EXAMPLES

To demonstrate the beneficial characteristics of the lubricant compositions according to certain embodiments, lubricants compositions were created that varied in the amount of branched acids used in formulating the polyol ester base stock. Table 1, below, lists the components that were used to formulate the variety of lubricant compositions. Two types of tests were then utilized to compare the oxidation characteristics of the resulting lubricant compositions.

TABLE 1

| Components of the Lubricant Compositions | |
|---|---|
| Ester A | pentaerythritol ester of isononanoic and 2-ethylhexanoic acids (100% branched acids) |
| Ester B | pentaerythritol ester of 2-ethylhexanoic acid (100% branched acid) |
| Ester C | trimethyolpropane ester of octanoic and decanoic acids (all linear acids) |
| Ester D | trimethyolpropane ester of octanoic, nonanoic and decanoic acids (all linear acids) |
| Ester E | isotridecyl ester of adipic acid (linear acid) |
| Ester F | pentaerythritol ester of pentanoic, hexanoic, heptanoic, octanoic, nonanoic and decanoic acids (all linear acids) |
| Ester G | pentaerythritol ester of pentanoic, hexanoic, heptanoic, octanoic and nonanoic acids (all linear acids) |
| Ester H | pentaerythritol ester of pentanoic, isopentanoic, octanoic, nonanoic and decanoic acids (20% branched acids and 80% linear acids) |
| Antioxidant A | alkylated diphenylamine |
| Antioxidant B | thiodiethylene bis--(3,5-di-tert-butyl-4-hydroxy) hydrocinnamate |
| Antioxidant C | methylene-bis-dibutyldithiocarbamate |
| Antioxidant D | ester of 3,5-di-tert-butyl-4-hydroxyhydrocinnamic acid |

TABLE 1-continued

| Components of the Lubricant Compositions | |
|---|---|
| Antioxidant E | alkylated phenyl alpha naphthylamine |
| Polyalphaolefin A | hydrogenated oligomers of decene, ~6 cSt at 100° C. |
| Polyalphaolefin B | hydrogenated oligomers of decene, ~8 cSt at 100° C. |
| Polyalkylene Glycol A | alcohol initiated polypropylene glycol, ~7 cSt at 100° C. |
| Polyalkylene Glycol B | alcohol initiated polypropylene glycol, ~11 cSt at 100° C. |
| Olefin Copolymer A | ethylene-alphaolefin copolymer, 600 cSt at 100° C. |
| Polyolefin A | polybutene, 650 cSt at 100° C. |
| Highly Paraffinic Fischer-Tropsch-Derived Base Fluid | ~8 cSt at 100° C. |

ASTM D2272 Oxidation Stability by Rotating Pressure Vessel

This test method utilizes an oxygen-pressurized vessel to evaluate the oxidation stability of lubricants in the presence of water and a copper catalyst coil at 150° C. The lubricant, water and copper catalyst coil are placed in a covered glass container, and this container is then placed in a vessel which is equipped with a pressure gauge. The vessel is charged with oxygen to a gauge pressure of 620 kPa (90 psi), and is then placed into a constant temperature oil bath or dry block which is heated to 150° C. The pressure vessel is rotated axially at 100 rpm at an angle of 30° from the horizontal. The pressure of the vessel is monitored during the test. The number of minutes required to reach a specific drop in gauge pressure (commonly 175 kPa or 25.4 psi less than the maximum pressure) is the oxidation stability (or oxidation lifetime) of the test lubricant. This test is used to compare the oxidation stability of lubricants and generate a relative ranking of the amount of service life which can be expected from various test lubricants.

ASTM D943 Oxidation Characteristics of Inhibited Oils

This test method covers the evaluation of the oxidation stability of lubricants in the presence of oxygen, water, and copper and iron catalyst coils at 95° C. The lubricant, water, and copper and iron catalyst coils are placed in a glass test tube which is then placed into a constant temperature oil bath which is heated to 95° C. Oxygen is contacted or bubbled into the lubricant at a rate of 3 liters per hour. The acid number of the lubricant is monitored during the test. The number of hours required to reach a specific increase in acid number (commonly 2.0 mg KOH/g or higher) is the oxidation stability (or oxidation lifetime) of the test lubricant. This test is used to compare the oxidation stability of lubricants and generate a relative ranking of the amount of service life which can be expected from various lubricants.

The results of this testing, contained in Tables 2-7 below, show that extended lubricant oxidation life is provided when a hindered polyol ester formed from hindered polyols and predominantly branched carboxylic acids are used instead linear carboxylic acids in conjunction with antioxidants and other base stocks. It should be noted that where the test results show a greater than (">") result, this indicates that the test was terminated at that point.

Examples 1-7 of Table 2, as follows, show that extended lubricant oxidation life is provided when a hindered polyol ester of predominantly branched carboxylic acids is used instead of other types of esters including hindered polyol esters using all linear acids or a diester in conjunction with antioxidants and other base stocks such as polyalphaolefins and olefin copolymers.

TABLE 2

| | Example Lubricant Compositions | | | | | | |
|---|---|---|---|---|---|---|---|
| | 1 | 2 | 3 | 4[A] | 5[A] | 6[A] | 7[A] |
| Components (by weight percent of total lubricant composition): | | | | | | | |
| Ester A (100% branched acids) | 30.0 | 30.0 | 30.0 | — | — | — | — |
| Ester C (all linear acids) | — | — | — | 30.0 | 30.0 | 30.0 | — |
| Ester E (linear acid used to form a diester) | — | — | — | — | — | — | 10.0 |
| Polyalphaolefin B | 68.6 | 68.8 | 68.8 | 64.6 | 64.8 | 64.6 | 87.2 |
| Olefin Copolymer A | — | — | — | 4.0 | 4.0 | 4.0 | — |
| Antioxidant A | 0.6 | 0.4 | 0.6 | 0.6 | 0.4 | 0.6 | 0.3 |
| Antioxidant B | 0.4 | 0.4 | 0.4 | 0.4 | 0.4 | 0.4 | 0.3 |
| Other performance additives | 0.4 | 0.4 | 0.4 | 0.4 | 0.4 | 0.4 | 2.2 |
| ISO Viscosity Grade | 46 | 46 | 46 | 46 | 46 | 46 | 46 |
| Test Results: | | | | | | | |
| Oxidation Life, D2272, minutes | 1490 | 1600 | 1580 | 1070 | 1171 | 1144 | 1320 |

[A]Comparative Example

Examples 8-14 of Table 3, as follows, show that extended lubricant oxidation life is provided when a hindered polyol ester of predominantly branched carboxylic acids is used instead of other types of esters including hindered polyol esters using all linear acids in conjunction with antioxidants and other base stocks such as polyalphaolefins, polyolefins and olefin copolymers.

TABLE 3

| | Example Lubricant Compositions | | | | | | |
|---|---|---|---|---|---|---|---|
| | 8 | 9[A] | 10 | 11[A] | 12 | 13[A] | 14 |
| Component: | | | | | | | |
| Ester A (100% branched acids) | 10.0 | — | 10.0 | — | 10.0 | — | 10.0 |
| Ester C (all linear acids) | — | — | — | 10.0 | — | 10.0 | — |
| Ester D (all linear acids) | — | 12.0 | — | — | — | — | — |
| Polyalphaolefin A | 42.8 | 39.2 | 62.9 | 60.9 | 53.4 | 49.9 | 51.7 |
| Olefin Copolymer A | — | — | 26.0 | 28.0 | — | — | — |
| Polyolefin A | 46.0 | 46.0 | — | — | 35.5 | 39.0 | 35.5 |
| Antioxidant A | 0.3 | 0.3 | 0.3 | 0.3 | 0.3 | 0.3 | 0.3 |
| Antioxidant B | 0.3 | 0.3 | 0.3 | 0.3 | 0.3 | 0.3 | 0.3 |
| Other performance additives | 0.6 | 2.2 | 0.5 | 0.5 | 0.5 | 0.5 | 2.2 |
| ISO Viscosity Grade | 460 | 460 | 220 | 220 | 220 | 220 | 220 |
| Test Results: | | | | | | | |
| Oxidation Life, D2272, minutes | 1137 | 819 | — | — | — | — | — |
| Oxidation Life, D943, hours | — | — | >2260 | 548 | 2092 | 470 | 1760 |

[A]Comparative Example

Examples 15-22 of Table 4, as follows, show that extended lubricant oxidation life is provided when a hindered polyol ester of predominantly branched carboxylic acids is used instead of other types of esters including hindered polyol esters using all linear acids in conjunction with antioxidants and other base stocks such as polyalphaolefins, polyolefins and olefin copolymers.

TABLE 4

| | Example Lubricant Compositions | | | | | | | |
|---|---|---|---|---|---|---|---|---|
| | 15 | 16 | 17 | 18 | 19 | 20 | 21[A] | 22[A] |
| Component: | | | | | | | | |
| Ester A (100% branched acids) | — | 10.0 | 10.0 | 10.0 | 10.0 | 10.0 | — | — |
| Ester B (100% branched acid) | 10.0 | — | — | — | — | — | — | — |
| Ester C (all linear acids) | — | — | — | — | — | — | 10.0 | 10.0 |
| Polyalphaolefin A | 48.1 | 52.4 | 59.9 | 57.0 | 52.5 | 57.0 | 52.5 | 52.5 |
| Olefin Copolymer A | — | — | 28.0 | 15.0 | — | 15.0 | — | — |
| Polyolefin A | 40.5 | 35.5 | — | 16.0 | 35.5 | 16.0 | 35.5 | 35.5 |
| Antioxidant A | 0.6 | 0.5 | 0.5 | 0.5 | 0.5 | 0.3 | 0.5 | 0.3 |
| Antioxidant B | 0.6 | 0.5 | 0.5 | 0.5 | 0.5 | 0.3 | 0.5 | 0.3 |
| Antioxidant C | — | — | — | — | — | 0.4 | — | 0.4 |
| Other performance additives | 0.2 | 1.1 | 1.1 | 1.0 | 1.0 | 1.0 | 1.0 | 1.0 |
| ISO Viscosity Grade | 220 | 220 | 220 | 220 | 220 | 220 | 220 | 220 |
| Test Results | | | | | | | | |
| Oxidation Life, D943, hours | >1343 | 2084 | 1580 | >1805 | >1805 | >1805 | 830 | 961 |

[A]Comparative Example

Examples 23-38 of Tables 5-6, as follows, show that extended lubricant oxidation life is provided when a hindered polyol ester of predominantly branched carboxylic acids is used instead of other types of esters including hindered polyol esters using all linear acids in conjunction with antioxidants and other base stocks such as polyalkylene glycols. As demonstrated by Example 38, improvement in lubricant life is seen when acids having at least 20% branching is used in forming the hindered polyol ester.

TABLE 5

| | Example Lubricant Compositions | | | | | | | |
|---|---|---|---|---|---|---|---|---|
| | 23 | 24 | 25[A] | 26 | 27[A] | 28 | 29[A] | 30 |
| Component: | | | | | | | | |
| Ester A (100% branched acids) | 35.0 | 35.0 | — | 10.0 | — | 20.0 | — | 35.0 |
| Ester F (all linear acids) | — | — | — | — | 10.0 | — | 20.0 | — |
| Ester G (all linear acids) | — | — | 35.0 | — | — | — | — | — |
| Polyalkylene glycol A | 47.3 | 47.2 | — | 35.0 | 25.0 | 35.0 | 10.0 | 25.0 |
| Polyalkylene glycol B | 15.0 | 15.0 | 62.2 | 52.2 | 62.2 | 42.2 | 67.2 | 37.2 |
| Antioxidant A | 1.0 | 1.0 | 1.0 | 1.0 | 1.0 | 1.0 | 1.0 | 1.0 |
| Antioxidant D | 1.0 | 1.0 | 1.0 | 1.0 | 1.0 | 1.0 | 1.0 | 1.0 |
| Other performance additives | 0.7 | 0.8 | 0.8 | 0.8 | 0.8 | 0.8 | 0.8 | 0.8 |
| ISO Viscosity Grade | 46 | 46 | 46 | 46 | 46 | 46 | 46 | 46 |
| Test Results | | | | | | | | |
| Oxidation Life, D2272, minutes | 955 | 980 | 660 | 623 | 565 | 770 | 634 | 810 |

[A]Comparative Example

TABLE 6

| | Example Lubricant Compositions | | | | | | | |
|---|---|---|---|---|---|---|---|---|
| | 31 | 32 | 33 | 34 | 35 | 36[A] | 37[A] | 38 |
| Component: | | | | | | | | |
| Ester A (100% branched acids) | 35.0 | 10.0 | — | — | — | — | — | — |
| Ester B (100% branched acid) | — | — | 35.0 | 35.0 | 35.0 | — | — | — |
| Ester F (all linear acids) | — | — | — | — | — | — | 30.0 | — |
| Ester G (all linear acids) | — | — | — | — | — | 35.0 | — | — |
| Ester H (20% branched acids) | — | — | — | — | — | — | — | 30.0 |
| Polyalkylene glycol A | 25.0 | 35.0 | 11.0 | 14.0 | 14.0 | — | — | — |
| Polyalkylene glycol B | 37.2 | 51.9 | 51.2 | 48.2 | 48.2 | 62.2 | 67.2 | 67.2 |
| Antioxidant A | 1.0 | 1.0 | 1.5 | 1.5 | 1.5 | 1.0 | 1.0 | 1.0 |
| Antioxidant E | 1.0 | 1.0 | — | 0.5 | 0.5 | — | — | — |
| Antioxidant D | — | — | 0.5 | — | — | 1.0 | 1.0 | 1.0 |
| Other performance additives | 0.8 | 1.1 | 0.8 | 0.8 | 0.8 | 0.8 | 0.8 | 0.8 |
| ISO Viscosity Grade | 46 | 46 | 46 | 46 | 46 | 46 | 46 | 46 |
| Test Results: | | | | | | | | |
| Oxidation Life, D2272, minutes | 1300 | 1230 | 832 | 1085 | 1435 | 660 | 577 | 630 |

[A]Comparative Example

Examples 39-42 of Table 7, as follows, show that extended lubricant oxidation life is provided when hindered polyol esters of predominantly branched carboxylic acids are used instead of other types of esters including hindered polyol esters using all linear acids in conjunction with antioxidants and other base stocks such as highly paraffinic Fischer-Tropsch-derived base fluids and olefin copolymers.

TABLE 7

| | Example Lubricant Compositions | | | |
|---|---|---|---|---|
| | 39[A] | 40 | 41[A] | 42 |
| Component: | | | | |
| Ester B (100% branched acid) | — | 30.0 | — | 15.0 |
| Ester C (all linear acids) | 30.0 | — | 15.0 | — |
| Highly Paraffinic Fischer-Tropsch-Derived Base Fluid | 68.8 | 68.8 | 59.7 | 59.7 |
| Olefin Copolymer A | — | — | 24.0 | 24.0 |
| Antioxidant A | 0.4 | 0.4 | 0.3 | 0.3 |
| Antioxidant B | — | — | 0.3 | 0.3 |
| Antioxidant F | 0.4 | 0.4 | — | — |
| Other performance additives | 0.4 | 0.4 | 0.7 | 0.7 |
| ISO Viscosity Grade | 32 | 32 | 220 | 220 |
| Test Results: | | | | |
| Oxidation Life, D2272, minutes | 1076 | 1939 | 1325 | 1876 |

[A]Comparative Example

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

The invention has been described with specific reference to the embodiments and modifications thereto described above. Further modifications and alterations may occur to others upon reading and understanding the specification. It is intended to include all such modifications and alterations insofar as they come within the scope of the invention.

The invention claimed is:

1. A lubricant composition comprising:

10 to 35 wt. % of a synthetic ester base stock based on a total weight of the lubricant composition, wherein the synthetic ester base stock is a reaction product of a mixture comprising:

one or more hindered organic polyols, and one or more carboxylic acids with a chain length of at least five carbons, wherein 100 mole% of the one or more carboxylic acids are branched;

55 to 90 wt. % of a paraffinic Fischer-Tropsch derived-based fluid;

optionally, at least one additional base stock; and a performance additive package comprising an antioxidant component, wherein the antioxidant component is present in an amount of from 0.3 to 5 wt.% based on the total weight of the lubricant composition, and wherein the antioxidant component comprises an alkylated phenyl-naphthyl amine, phenyl-naphthyl amine, or combinations thereof.

2. A lubricant composition comprising:

10 to 35 wt. % of a synthetic ester base stock based on a total weight of the lubricant composition, wherein the synthetic ester base stock is a reaction product of a mixture comprising:

one or more hindered organic polyols, and one or more carboxylic acids with a chain length of at least five carbons, wherein 100 mole % of the one or more carboxylic acids are branched;

55 to 90 wt. % of at least one additional base stock based on the total weight of the lubricant composition, wherein the at least one additional base stock is selected from the group consisting of paraffinic Fischer-Tropsch-derived base fluids; polyalkylene glycols, polyglycol ethers, polyethers, polyolefins, olefin copolymers, polyalphaolefins, polybutene, and mixtures thereof; and a performance additive package comprising an antioxidant component, wherein the antioxidant component is present in an amount of from 0.3 to 5 wt. % based on the total weight of the lubricant composition, and wherein the antioxidant component comprises phenyl-naphthyl amine.

3. The lubricant composition of claim 2, wherein the at least one additional base stock comprises a paraffinic Fischer-Tropsch-derived base fluid.

4. The lubricant composition of claim 2, wherein the at least one additional base stock comprises at least two additional base stocks, each independently selected from the group consisting of polyalkylene glycols, polyglycol ethers, polyethers, polyolefins, olefin copolymers, polyalphaolefins, polybutene, paraffinic Fischer-Tropsch-derived base fluids, or mixtures thereof.

5. The lubricant composition of claim 2, wherein the at least one additional base stock comprises at least three additional base stocks, each independently selected from the group consisting of polyalkylene glycols, polyglycol ethers, polyethers, polyolefins, olefin copolymers, polyalphaolefins, polybutene, paraffinic Fischer-Tropsch-derived base fluids, and mixtures thereof.

6. The lubricant composition of claim 2, wherein the branched carboxylic acid has a chain length that is six or more carbon atoms.

7. The lubricant composition of claim 2, wherein the branched carboxylic acid has a chain length that consists of eight or nine carbon atoms, or a mixture thereof.

8. The lubricant composition of claim 2, wherein the branched carboxylic acid has a chain length that consists of eight carbon atoms.

9. The lubricant of claim 2, wherein the branched carboxylic acids are selected from the group consisting of 2-ethylhexanoic acid, isononanoic acid, and combinations thereof.

10. The lubricant composition of claim 2 comprising 0.1 to 10 wt. % of the performance additive package based on the total weight of the lubricant composition.

11. The lubricant composition of claim 2, wherein the one or more hindered organic polyols comprises one or more pentaerythritols selected from the group consisting of: monopentaerythritol, dipentaerythritol, tripentaerythritol, and tetrapentaerythritol.

12. The lubricant composition of claim 2, wherein the one or more hindered organic polyols comprises one or more trimethylolpropane-based components selected from the group consisting of trimethylolpropane and di-trimethylolpropane.

13. The lubricant composition of claim 2, wherein the synthetic ester is the reaction product of one or more pentaerythritols selected from the group consisting of: monopentaerythritol, dipentaerythritol, tripentaerythritol, and tetrapentaerythritol with one or more branched carboxylic acids selected from the group consisting of 2-ethylhexanoic acid and isononanoic acid.

14. The lubricant composition of claim 2, wherein the paraffinic Fischer-Tropsch-derived base fluid comprises a highly paraffinic Fischer-Tropsch-derived base fluid.

15. The lubricant composition of claim 2, wherein the antioxidant component is present in an amount of from 0.6 to 5 wt. % based on the total weight of the lubricant composition.

16. A method of lubricating a piece of equipment, the method comprising: providing the lubricant composition of claim 2 and filling a chamber or exposing a surface of the equipment with the lubricant composition.

17. The method of claim 16, wherein the equipment is selected from the group consisting of: air compressors, gear boxes, bearing sets, hydraulic systems, and chain drives.

18. The lubricant composition of claim 1, wherein the one or more hindered organic polyols comprises one or more pentaerythritols selected from the group consisting of: monopentaerythritol, dipentaerythritol, tripentaerythritol, and tetrapentaerythritol.

19. The lubricant of claim 1, wherein the branched carboxylic acids are selected from the group consisting of 2-ethylhexanoic acid, isononanoic acid, and combinations thereof.

20. The lubricant composition of claim 1 further comprising an olefin copolymer as the at least one additional base stock.

* * * * *